United States Patent [19]

Lay et al.

[11] Patent Number: 4,497,098

[45] Date of Patent: Feb. 5, 1985

[54] FILL YARN REMOVAL APPARATUS

[75] Inventors: Khin M. Lay, Gardena; Stephen E. Palguta, Redondo Beach, both of Calif.

[73] Assignee: HITCO, Newport Beach, Calif.

[21] Appl. No.: 415,526

[22] Filed: Sep. 7, 1982

[51] Int. Cl.[3] ..... D02G 3/00

[52] U.S. Cl. ..... 28/171

[58] Field of Search ..... 28/170, 171, 218, 108, 28/164

[56] References Cited

U.S. PATENT DOCUMENTS

| | | | |
|---|---|---|---|
| 3,297,057 | 1/1967 | Mizuno et al. | 28/170 X |
| 3,313,323 | 4/1967 | Calemard | 28/170 X |
| 4,118,842 | 10/1978 | Norris et al. | 28/171 |

*Primary Examiner*—Werner H. Schroeder
*Assistant Examiner*—Andrew M. Falik
*Attorney, Agent, or Firm*—Fraser and Bogucki

[57] ABSTRACT

Apparatus for removing a fill yarn from a web of warp tows advances the web lengthwise across a tabletop having opposite pairs of bars at the leading edge thereof for separating the outermost tow at each of the opposite edges of the web from the remaining tows within the web. Rotatable cutting wheels which are resiliently urged against the top of a rotating shaft at the underside of the web sever the fill yarn between the outermost tows and the remaining tows of the web to form separate fill yarn lengths extending across the width of the web. As the advancing web is then divided along a central portion thereof, the separate lengths of fill yarn are removed by a hook mounted within a central portion of the tabletop and reciprocating between positions above and below the tabletop so as to hook each separate length of fill yarn and begin pulling it down through the tabletop. As each length of fill yarn is pulled down through the tabletop by the hook, it is engaged by a pair of opposing rollers and pulled into the inside of a hollow duct where an air stream carries the length of fill yarn away for disposal.

19 Claims, 10 Drawing Figures

FILL YARN REMOVAL APPARATUS

BACKGROUND OF THE INVENTION

1. Field of the Invention

The present invention relates to apparatus for handling a web of material made up of individual tows, and more particularly to apparatus for removing a fill yarn which is alternately interlaced with the web across the width thereof so as to hold the individual tows thereof together for prior processing.

2. History of the Prior Art

It is known to weave or interlace a length of fill yarn alternately back and forth across the width of a web of individual tows disposed in side-by-side relation across the width of the web so as to hold the tows in place for processing thereof. During the carbonization of filaments of PAN or similar material, for example, it is common practice to weave a length of fill yarn back and forth across the width of the web prior to carbonization so as to hold the individual tows of filaments in place as part of an integral woven structure. The resulting web tends to minimize or avoid damage of the delicate filaments as the web is advanced over rollers and other equipment during the carbonization of the filaments. Apparatus for inserting the fill yarn to form such a web is described in U.S. Pat. No. 4,173,990 of Langlois et al, issued Nov. 13, 1979 and commonly assigned with the present application.

Upon completion of carbonization or other processing requiring the presence of the fill yarn, it is usually necessary that the fill yarn be removed so that other processing or ultimate utilization of the tows comprising the web can take place. This is usually accomplished using one of several techniques involving a substantial amount of manual labor. In the most common of such techniques the different lengths of fill yarn extending across the width of the web are cut at approximately their midpoints by scissors or other appropriate cutting instruments as the web is advanced through a work area. Following that, the loops of fill yarn at the opposite edges of the web are grabbed and pulled by hand to remove the cut pieces of the fill yarn. Such process is relatively slow and tedious. It typically requires the full time and attention of two people, one standing on each side of the web which is typically three to four feet or more in width. At the same time the process is relatively slow because of the time required to hand cut and hand remove the fill yarn. Optimum speed for such a process is usually about five feet per minute of web advance.

Accordingly, it would be desirable to be able to provide an improved technique and improved apparatus for removing fill yarn from a web of tows. It would be especially advantageous to be able to remove the fill yarn automatically by machine so as to eliminate the need for manual labor and require only occasional operator supervision. It would furthermore be advantageous to be able to remove the fill yarn from a web of tows at speeds greatly in excess of those realizable with present manual techniques.

BRIEF DESCRIPTION OF THE INVENTION

The foregoing and other objects are achieved in accordance with the invention by apparatus which cuts and removes the fill yarn automatically, at a relatively high rate of speed and requiring only a small amount of worker time. As the web is advanced across a tabletop, opposite pairs of separator bars at the leading edge of the tabletop are utilized to separate the outermost tow at each of the opposite edges of the web from the remaining tows. Rotating cutting wheels which are resiliently forced into engagement with a cylindrical bar rotatably driven at the underside of the web sever the fill yarn in the spaces between the outermost tows and the remaining tows to form separate lengths of the fill yarn extending across the width of the web. Jets of air are directed along the sides of the cutting wheels to blow the advancing cut ends of the fill yarn out of the paths of the cutting wheels to prevent the cut ends from being cut again.

As the web with the severed lengths of fill yarn therein is advanced over the tabletop, it is separated along a central portion thereof by directing opposite groups of the tows around a separating element mounted adjacent the opposite end of the tabletop from the leading edge and extending upwardly above the upper surface of the tabletop. The separate lengths of fill yarn created by the cutting process are engaged and removed from the web by an arrangement which includes a reciprocating hook, an opposing pair of rollers and an air duct. The hook is mounted for reciprocating movement within a slot in a shaft extending upwardly from the tabletop and into the space between the separated halves of the web. As the web is advanced across the tabletop and around the shaft, the hook engages a central portion of each passing length of fill yarn and pulls it through the slot in the shaft and a joining aperture in the tabletop to the area below the tabletop where the fill yarn portion is engaged by a pair of opposing rollers.

The rollers which have circumferential slots therein for receiving the hook are disposed on opposite sides of the hook and are rotatably driven in opposing directions so as to grasp the length of fill yarn and continue pulling it downwardly until the entire length is removed from the web and pulled down through the points of contact of the rollers. At the same time the rollers feed the length of fill yarn into the interior of a hollow, elongated duct mounted below the rollers and having apertures therein for receiving the hook. A continuous stream of air directed through the duct by a blower coupled to the duct carries away each length of fill yarn for disposal in a trash container or other appropriate disposition.

The hook has an elongated shaft portion thereof extending downwardly from a hook portion at the upper end thereof. The shaft portion is slidably received within a mounting arrangement which mounts the hook for reciprocation along a generally vertical axis. The lower end of the shaft portion is pivotally coupled to the first end of a connecting rod having an opposite second end thereof coupled to the first end of a crank. An opposite second end of the crank is pivotally mounted and coupled to be rotatably driven. As the crank is rotated about the second end thereof, the attached connecting rod drives the shaft portion of the hook upwardly and then downwardly in reciprocating fashion.

A desired amount of tension is maintained within the separated tows at the opposite edges of the web by tensioning arrangements mounted at opposite sides of the tabletop at the downstream or trailing edge thereof. Each such arrangement includes a lever arm pivotally mounted at a first end thereof and having an opposite second end for rotatably mounting a dancer wheel. The dancer wheel rests on the separated tow so as to maintain the tow in tension and thereby facilitate the cutting of the fill yarn. If the dancer wheel drops below a certain level indicating the absence of the minimum tension in the separated tow necessary to prevent the accidental cutting of the separated tow, a cutoff switch is activated to stop the advance of the web across the tabletop.

BRIEF DESCRIPTION OF THE DRAWING

The foregoing and other objects, features and advantages of the invention will be apparent from the following more particular description of a preferred embodiment of the invention, as illustrated in the accompanying drawings, in which.

DETAILED DESCRIPTION

Figure 1:
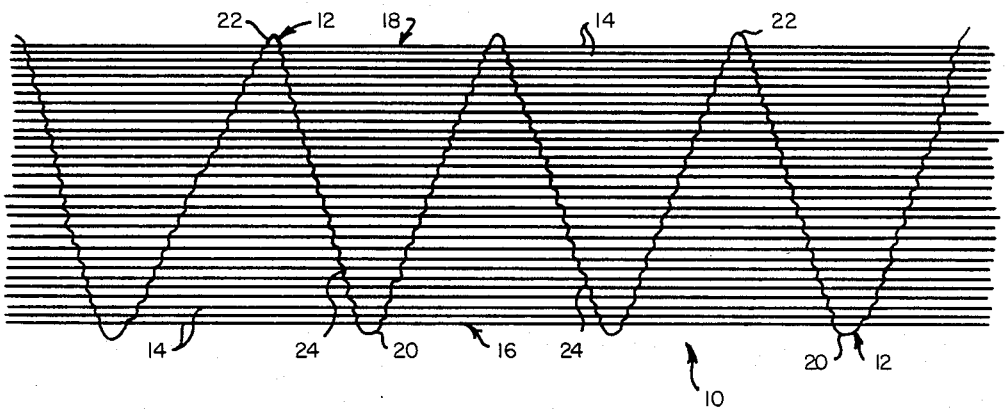
FIG. 1 is a plan view of a web of warp tows having a fill yarn interwoven therewith.

FIG. 1 depicts a web 10 having a fill yarn 12 interwoven with a plurality of warp tows 14. The tows 14 extend longitudinally along the length of the web 10 and are arranged in side-by-side relation across the width of the web 10 between opposite edges 16 and 18. In the present example each of the tows 14 is comprised of 1,000–12,000 filaments of oxidized PAN material. For simplicity of illustration only a relatively small number of the tows 14 are shown in FIG. 1. In actual practice a greater number of tows 14 is present, and the web 10 may have a width between the opposite edges 16 and 18 of as much as 52".

The tows 14 are held together in the manner of an integral fabric by the fill yarn 12. The fill yarn 12 extends alternately back and forth across the width of the web 10 in the direction of the length of the web 10. In the present example the fill yarn 12 is interwoven or interlaced with the tows 14 so as to undulate over and under the various tows 14 with a given phase as the yarn 12 extends across the width of the web 10 to one of the opposite edges 16 and 18. The fill yarn 12 then undulates over and under the various tows 14 but in an opposite phase as it begins its next traversal of the width of the web 10. At the opposite ends of the traversals of the width of the web 10, the fill yarn 12 forms a series of small loops 20 along the edge 16 of the web 10 and a series of small loops 22 along the edge 18 of the web 10.

As previously noted the fill yarn 12 is interwoven with the tows 14 in order to form a temporary integral fabric for purposes of facilitating the handling and processing of the tows 14. In the present instance the fill yarn 12 which comprises carbon yarn is added to facilitate the carbonization of the oxidized PAN filaments comprising the tows 14. Upon completion of the carbonization process, it is necessary to remove the fill yarn 12 prior to dividing the tows 14 into different groups for winding on storage spools. The fill yarns 12 are typically removed by hand. As the web 10 is advanced slowly in a longitudinal direction and is gradually separated along a central portion thereof, operators standing adjacent the opposite edges 16 and 18 cut the fill yarn 12 at the a plurality of central portion of different lengths 24 of the fill yarn 12 extending across the width of the web 10. By pulling on the loops 20 and 22, the cut pieces of the fill yarn 12 are removed from the web 10. The process is a relatively slow one requiring considerable manpower. Normally, the web 10 cannot be advanced at a speed much greater than about 5 feet per minute past the personnel removing the fill yarn 12.

Figure 2:
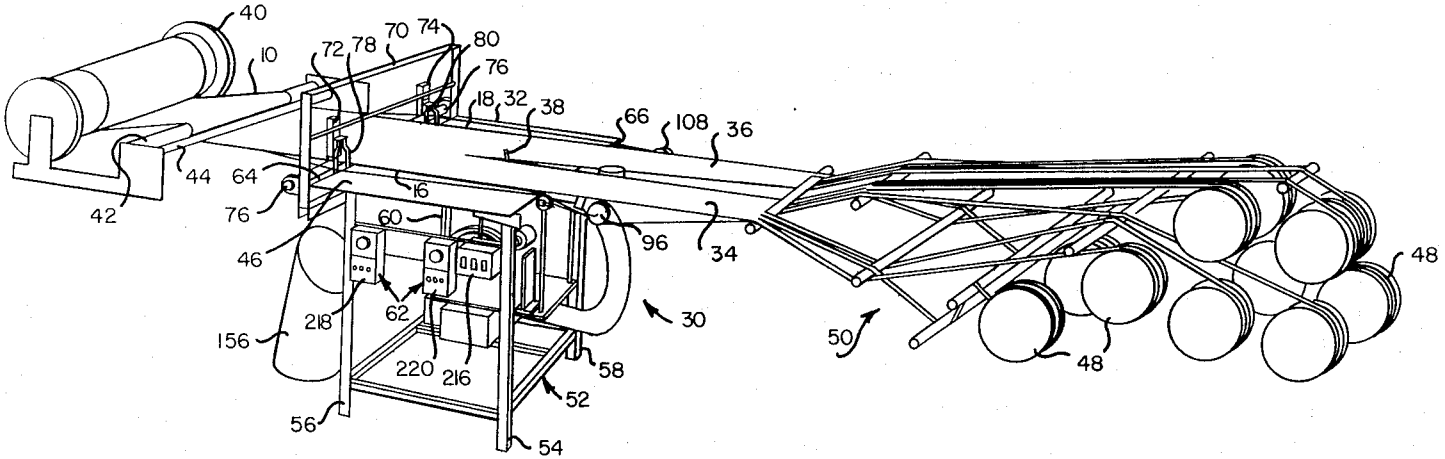
FIG. 2 is a perspective view of fill yarn removal apparatus in accordance with the invention for removing the fill yarn from a web of the type shown in FIG. 1.

In accordance with the invention the fill yarn 12 is removed from the web 10 automatically using fill yarn removal apparatus 30 which is shown in FIG. 2 as well as in various other figures. As will be described in detail, the apparatus 30 cuts the fill yarn 12 substantially at a halfway point in each of the loops 20 and 22 as the web 10 is advanced across a relatively flat tabletop 32 defining a work area for the apparatus 30. The web 10 is then separated into opposite halves 34 and 36 prior to reaching a fill catcher 38 extending upwardly from a central portion of the tabletop 32. The fill catcher 38 catches and removes the lengths 24 of cut fill yarn.

The web 10 is supplied to the apparatus 30 from a roll 40 upon which a length of the web 10 is wound. The web 10 is unwound from the rotatably mounted roll 40 and is then drawn over a bar 42 and under a bar 44 prior to being advanced across a relatively flat upper surface 46 of the tabletop 32. Following the cutting and removal of the fill yarn 12 from the web 10, the various tows 14 of the web 10 are divided into different groups prior to being wound onto a plurality of different spools 48. As shown in FIG. 2 the opposite halves 34 and 36 of the web 10 are further divided into smaller groups of the tows 14 by an arrangement 50 of rollers and bars. In the present example, the web 10 is divided into twelve generally equal sized groups of the tows 14 by the arrangement 50 for winding onto twelve of the spools 48.

The tabletop 32 is supported by a frame 52 having four legs 54, 56, 58 and 60. Mounted on the side of the frame 52 are a plurality of controls 62 for the apparatus 30. The tabletop 32 has a front edge 64 thereof and an opposite rear edge 66 thereof. The web 10 is advanced across the upper surface 46 of the tabletop 52 in a direction from the front edge 64 to the rear edge 66 so that the rear edge 66 lies downstream from the front edge 64.

A support 70 mounted on the frame 52 adjacent the front edge 64 of the tabletop 32 mounts an opposite pair of fill yarn cutters 72 and 74 together with a rotating cylindrical shaft 76. The cutters 72 and 74 are mounted in spaced-apart relation so as to be disposed adjacent the opposite edges 16 and 18 respectively of the web 10. The rotating cylindrical shaft 76 is disposed just below the underside of the web 10 and provides for the counterrotation of the cutters 72 and 74 relative thereto to enhance the cutting action. Mounted on the support 70 adjacent the fill yarn cutter 72 is a first pair of separator bars 78. A second pair 80 of separator bars is mounted on the support 70 adjacent the fill yarn cutter 74. As described hereafter the first pair of separator bars 78 separates an outermost tow from the remaining tows of the web 10 at the edge 16 to facilitate cutting of the fill yarn 12 by the fill yarn cutter 72 in conjunction with the shaft 76. Likewise, the second pair of separator bars 80 serve to separate an outermost tow at the edge 18 of the web 10 to facilitate cutting of the fill yarn 12 by the fill yarn cutter 74 in conjunction with the cylindrical shaft 76.

Figure 3:
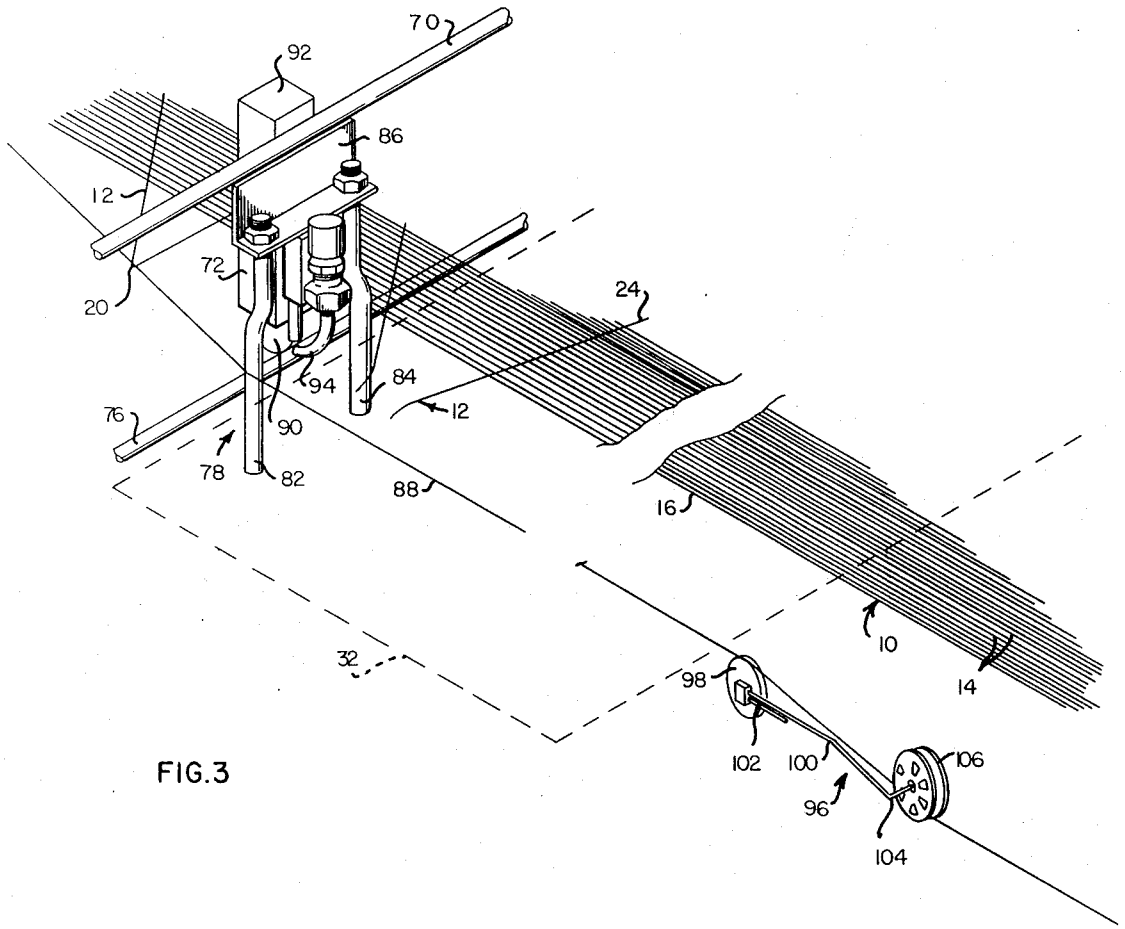
FIG. 3 is a perspective view of a portion of the fill yarn removal apparatus of FIG. 2 showing details of the separator bars, the cutting wheel and a dancer wheel tow tensioning arrange- ment.

The details of the fill yarn cutter 72 and the first pair of separator bars 78 are shown in FIG. 3. The first pair of separator bars 78 consists of an outer bar 82 and an inner bar 84 which are generally vertically disposed and which are bolted to the opposite ends of a bracket 86 which is secured to the support 70. The bars 82 and 84 extend downwardly from a region above the upper surface 46 of the tabletop 32 to a region below the upper surface 46 so as to extend through the path of the web 10. The outer and inner bars 82 and 84 are spaced from each other by a selected distance that an outer tow is to be separated from the remainder of the tows 14 of the web 10. The purpose of separating the tow 88 from the remaining tows is to facilitate cutting the fill yarn 12. As the web 10 is advanced onto the tabletop 32 the outer tow 88 is pulled outwardly from the remaining tows 14 of the web 10 causing each loop 20 of the fill yarn 12 to be extended outwardly from the edge 16 of the web 10.

As each loop 20 of the fill yarn 12 advances to the outer and inner bars 82 and 84, the two short lengths of yarn forming the loop 20 are pulled over the rotating cylindrical shaft 76. This causes the leading one of the short lengths to be cut by a cutter blade in the form of a rotatable cutting wheel 90 which bears on the top of the shaft 76. The cutting wheel 90 which forms a part of the fill yarn cutter 72 is mounted at the lower end of a housing 92 mounted on the support 70. A spring (not shown) within the housing 92 exerts a downward force on the cutting wheel 90 to maintain the wheel 90 in contact with the shaft 76. Only the leading one of the two shorts lengths of fill yarn forming the loop 20 is cut by the wheel 90. When this happens the resulting yarn ends pull free of the outer tow 88. A stream of air from a tube 94 is directed along the side of the cutting wheel 90 to blow the trailing one of the short lengths of fill yarn forming the loop 20 away from the cutting wheel 90 to prevent its being cut. The tube 94 is coupled to any appropriate air supply.

To achieve proper cutting action, it is necessary that a minimum amount of tension be maintained in the outer tow 88 in order to pull the loops 20 of the fill yarn 12 away from the outer edge 16 of the web 10. A tensioning device 96 serves to increase the tension in the outer tow 88 so that proper cutting can take place. The tensioning device 96 includes a pulley 98 rotatably mounted on the tabletop 52 and supporting the outer tow 88. An elongated arm 100 has a first end 102 thereof pivotally coupled to the tabletop 32 in the region of the pulley 98 and an opposite second end 104 which rotatably mounts a dancer wheel 106. The outer tow 88 which extends over the pulley 98 is then directed downwardly and under the dancer wheel 106. The action of the arm 100 and the dancer wheel 106 pulling down on the outer tow 88 tends to maintain a proper amount of tension in the outer tow 88.

If the tension in the outer tow 88 decreases below a minimum value required to prevent the accidental cutting on the tow 88 by the cutter 72, the dancer wheel 106 drops below a predetermined level. When this happens the elongated arm 100 has rotated to such an extent that a shaft 107 coupled to the end 102 of the arm 100 and shown in FIG. 4 trips a switch 109 mounted at the rear edge 66 of the tabletop 32 to stop rotation of the roll 40 and thereby the advance of the web 10 across the tabletop 32.

The pulley 98 and the first end 102 of the arm 100 are pivotably mounted on the tabletop 32 at one side thereof adjacent the rear edge 66. A tensioning device 108 of construction similar to the tensioning device 96 is mounted on the opposite side of the tabletop 32 adjacent the rear edge 66 and serves to maintain tension in an outer tow at the edge 18 of the web 10 to facilitate cutting of the loops 22 of the fill yarn 12 by the fill yarn cutter 74.

Figure 4:
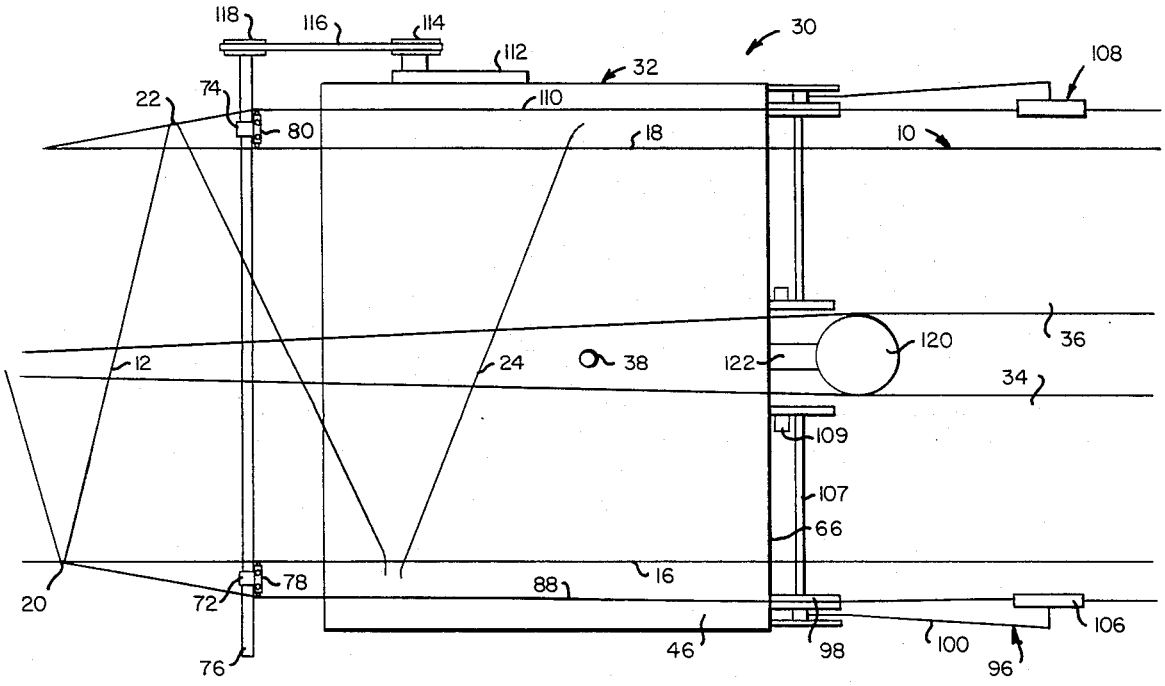
FIG. 4 is a top view of the fill yarn removal apparatus of FIG. 2.

FIG. 4 is a top view of the apparatus 30. As seen in FIG. 4 the outer tow 88 at the edge 16 of the web 10 is separated from the web 10 by the first pair of separator bars 78 to facilitate cutting of the loops 20 by the fill yarn cutter 72. In like fashion the second pair of separator bars 80 function to separate an outer tow 110 from the opposite edge 18 of the web 10 to facilitate cutting of the fill yarn 12 at the loops 22 by the fill yarn cutter 74. Upon cutting of the fill yarn 12 at the opposite loops 20 and 22, the lengths 24 of the fill yarn 12 remain interwoven with the various tows 14 of the web 10. The various lengths 24 are then removed by the fill catcher 38 in the manner described hereafter.

The rotating cylindrical shaft 76 is rotatably driven by a motor 112 mounted on the underside of the tabletop 32. The motor 112 is coupled to the cylindrical shaft 76 by a sprocket 114 mounted on the motor shaft, a chain 116 and a sprocket 118 mounted on the cylindrical shaft 76. As previously noted the shaft 76 is disposed just below the web 10 and in contact with the cutting wheels such as the wheel 90. The shaft 76 is normally driven in the same direction as and slightly slower than the speed of advance of the web 10 to prevent any portion of the web 10 from wrapping around the shaft 76.

Separation of the web 10 into the opposite halves 34 and 36 is aided by a generally cylindrical separating element 120 coupled via a bracket 122 to the tabletop 32 at a central portion of the rear edge 66 thereof. The separating element 120 extends upwardly above the level of the upper surface 46 of the tabletop 32 so as to extend well into the plane of the web 10.

Figure 5:
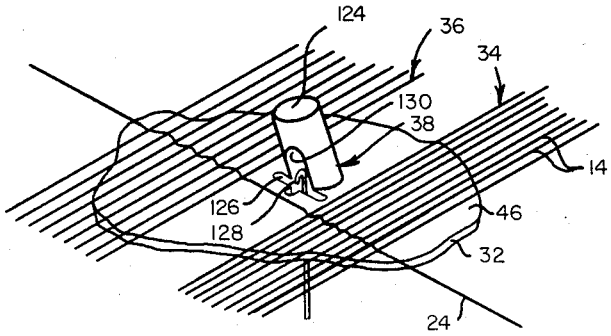
FIG. 5 is a perspective view of a small portion of the fill yarn removal apparatus of FIG. 2 illustrating a reciprocating hook used to remove severed lengths of fill yarn from the web.

FIG. 5 depicts the fill catcher 38 together with the adjacent portion of the tabletop 32 where the web 10 begins to divide into the opposite halves 34 and 36 thereof. It will be seen that as the opposite halves 34 and 36 of the tows 14 are separated, a central portion of the cut length 24 of the fill yarn 12 is exposed. As the web 10 advances across the tabletop 32, the length 24 of fill yarn eventually reaches the fill catcher 38.

The fill catcher 38 comprises a generally cylindrical shaft 124 extending upwardly from the upper surface 46 of the tabletop 32 adjacent an aperture 126 in the tabletop 32. The shaft 124 is inclined slightly forwardly from the vertical in the direction of the oncoming lengths 24 of fill yarn 12. A hook 128 is mounted within a slot 130 in the side of the shaft 124. As described hereafter the hook 128 is driven upwardly and downwardly in reciprocating fashion so as to engage the length 24 of fill yarn 12 and pull it down into the slot 130 so as to remove the length 24 from the web 10. The forward inclination of the shaft 124 prevents the oncoming lengths 24 of fill yarn 12 from falling behind the hook 128.

Figure 6:
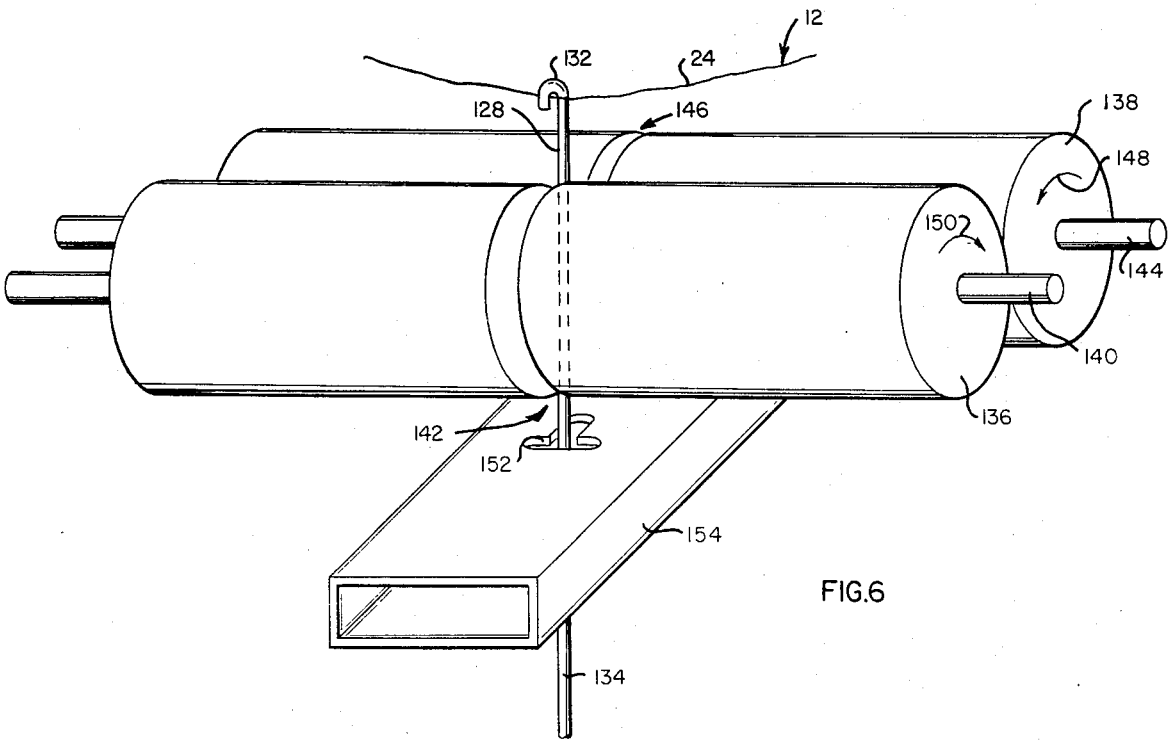
FIG. 6 is a perspective view of a large portion of the hook of FIG. 5 together with a pair of opposing rollers and an air duct used to complete removal of the severed lengths of fill yarn from the web and dispose of such lengths.

Referring to FIG. 6 the hook 128 is shown as it engages the central portion of the length 24 of the fill yarn 12. The tabletop 32 is omitted from FIG. 6 for clarity of illustration. The hook 128 has an upper curved end forming a hook portion 132 and an elongated, generally vertically disposed shaft portion 134 thereunder. Disposed immediately beneath the tabletop 32 is an opposing pair of rollers 136 and 138 disposed on opposite sides of the hook 128 and engaging one another. The roller 136 which is mounted on a shaft 140 has a circumferential slot 142 therein for accommodating the hook 128. In like fashion the roller 138 is mounted on a shaft 144 and has a circumferential slot 146 in a central portion thereof for accommodating the hook 128.

As previously noted in connection with FIG. 5, the hook 128 engages a central portion of the length 24 of the fill yarn 12 as the length 24 contacts the shaft 124. As the reciprocating hook 128 begins to move downwardly, the length 24 is pulled by the hook 128 into and downwardly through the aperture 126 in the tabletop 32. Referring again to FIG. 6, as the hook 128 continues to pull the length 24 down through the slot 130, a point is eventually reached where the length 24 is drawn into the opposing rollers 136 and 138. As described hereafter in connection with FIG. 9, the roller 138 is rotatably driven in a direction shown by an arrow 148. The roller 136 which is maintained in engagement with the roller 138 is thereby caused to rotate in an opposite direction as shown by an arrow 150. The opposing rotation of the rollers 136 and 138 draws the length 24 of the fill yarn 12 therebetween and then downwardly as the rollers continue to rotate. This aids in removing the length 24 from the web 10. It also aids in feeding the length 24 through a slot 152 in the top of a hollow duct 154 disposed below the rollers 136 and 138. The shaft portion 134 of the hook 128 extends through a small aperture in the bottom of the duct 154 and then to a region well below the duct 154 where it is driven in reciprocating fashion.

As described hereafter the interior of the duct 154 is coupled to a blower so as to provide the continuous flow of an air stream therethrough. As the air stream passes by the shaft portion 134 and the slot 152 where the length 24 of fill yarn 12 is collected, the length of fill yarn which is released from the hook 128 by upward movement of the hook 128 is carried along the interior of the duct 154 by the air stream to an outer end where it is deposited in a trash container 156. The trash container 156 is shown in FIGS. 2 and 7.

Figure 7:
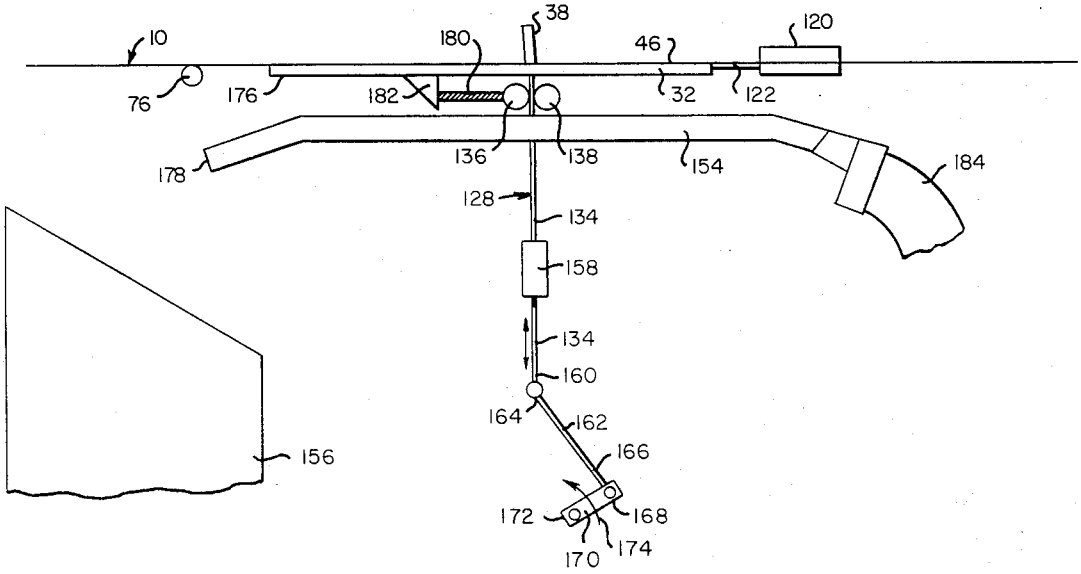
FIG. 7 is a side elevation of a portion of the fill yarn removal apparatus of FIG. 2 illustrating the mechanism for reciprocating the hook shown in FIGS. 5 and 6.

The details and manner of operation of the hook 128, the rollers 136 and 138 and the duct 154 may be better understood with reference to FIG. 7. As seen in FIG. 7 the shaft portion 134 of the hook 128 extends downwardly through a bearing block 158 to a lower end 160 thereof. The bearing block 158 together with the shaft 124 mount the hook 128 for reciprocating movement along a generally vertical axis. Reciprocation of the hook 128 is provided by an arrangement which includes a connecting rod 162 having a first end 164 thereof pivotally coupled to the lower end 160 of the hook 128. An opposite second end 166 of the connecting rod 162 is pivotally coupled to a first end 168 of a crank 170. The crank 170 is pivotally mounted at an opposite second end 172 thereof for rotation in a direction shown by an arrow 174. Rotation of the crank 170 causes upward and downward reciprocation of the hook 128.

As the hook 128 reciprocates, the hook portion 132 thereof reciprocates between an uppermost position in which it resides above the upper surface 46 of the tabletop 32 as shown in FIG. 5 and a lowermost position in which the hook portion 132 is pulled through the slot 152 at the top of the duct 154 into the interior of the duct 154. As the hook portion 132 undergoes downward movement to a point below a lower surface 176 of the tabletop 32 in the vicinity of the opposing rollers 136 and 138, the rollers 136 and 138 engage and help in the downward pulling of the length 24 of fill yarn 12 as previously described. As the hook portion 132 enters the interior of the duct 154 the rollers 136 and 138 continue to draw the length 24 from the web 10 down through the aperture 126 in the tabletop 32 and into the interior of the duct 154. When substantially all of the length 24 of the fill yarn 12 has passed through the opposing rollers 136 and 138 and into the interior of the duct 154, the air stream within the duct 154 carries the length 24 to an open end 178 of the duct 154 where the length 24 is deposited in the trash container 156. The roller 138 which is of stainless steel construction is mounted on the shaft 144 for rotation about a relatively fixed axis relative to the lower surface 176 of the tabletop 32. The roller 136 which is of rubber construction and which is mounted on the shaft 140 is held in contact with the roller 138 by a plurality of springs with one such spring 180 being shown in FIG. 7. The spring 180 extends between a fixed reference member 182 mounted on the lower surface 176 of the tabletop 32 and a rotatable mount for the shaft 140. The air stream within the duct 154 is provided by a blower which is connected to the duct 154 via a hose 184.

Figure 9:
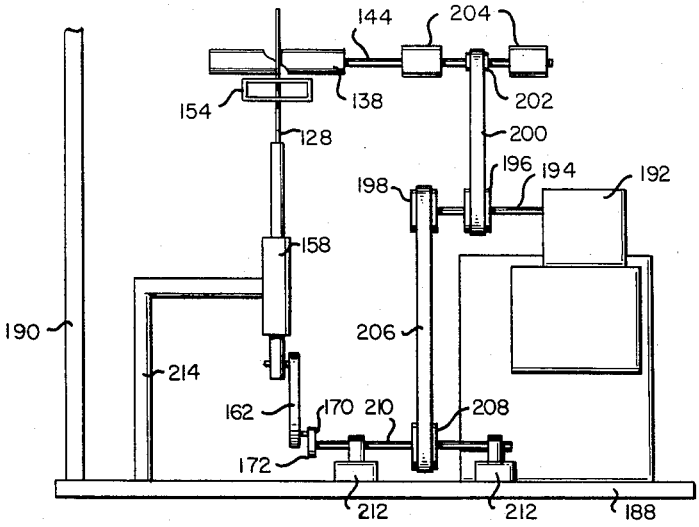
FIG. 9 is a front elevation of a portion of the fill yarn removal apparatus of FIG. 2 beneath the tabletop and showing further details of an arrangement for reciprocating the hook and rotatably driving the opposing rollers of FIG. 6.
Figure 8:
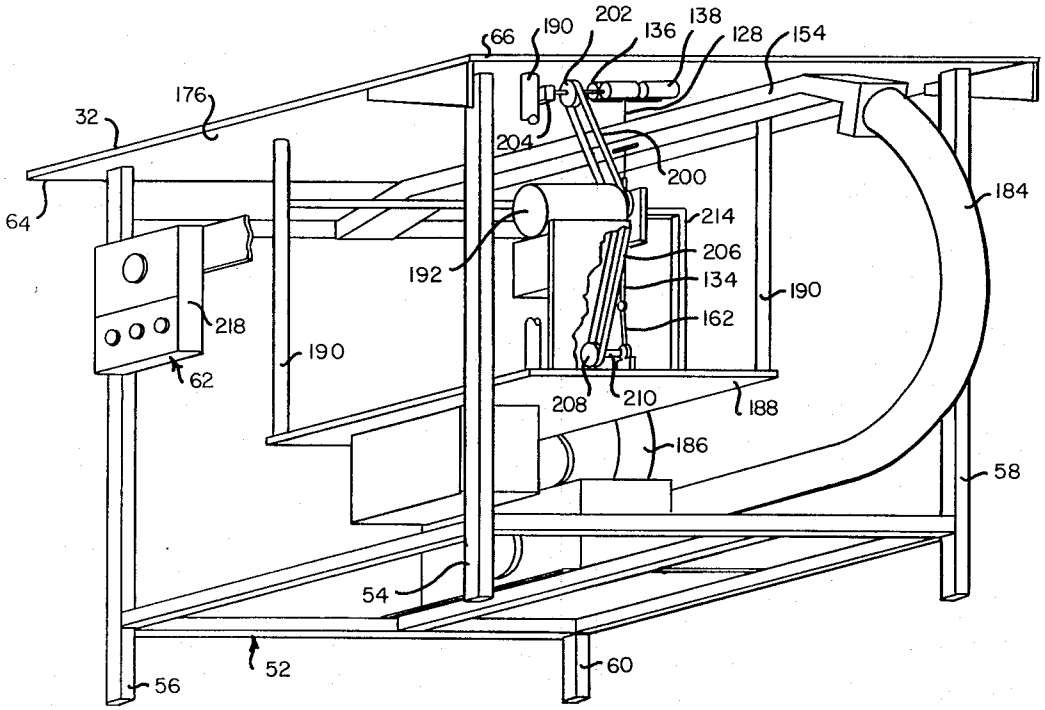
FIG. 8 is a perspective view of the fill yarn removal apparatus of FIG. 2 taken from a different angle so as to show some of the underside details thereof.
Figure 10:
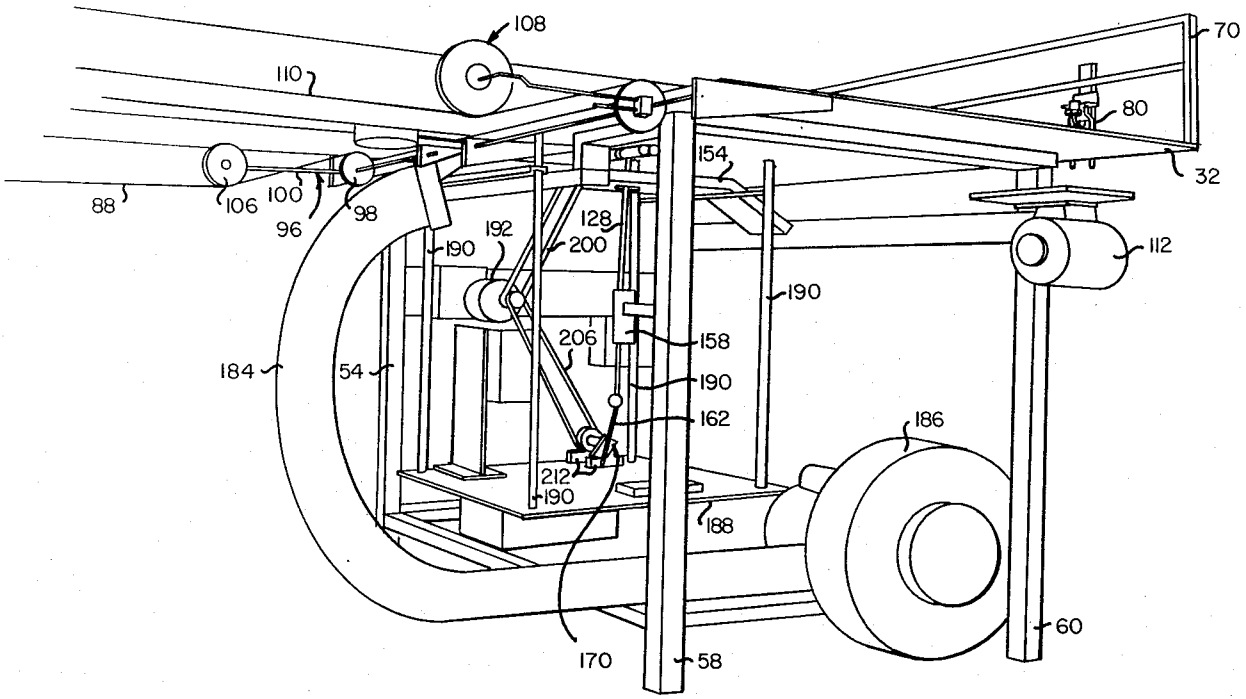
FIG. 10 is a perspective view of the fill yarn removal apparatus of FIG. 2 taken from a different angle and showing some of the details thereof under the tabletop.

FIGS. 8–10 show some of the details of the underside of the apparatus 30 including the mechanism for reciprocating the hook 128 and driving the rollers 136 and 138. As seen in FIG. 8 the hose 184 couples the duct 154 to a blower 186 mounted on the frame 52. A platform 188 is suspended from the lower surface 176 of the tabletop 32 by a plurality of rods 190. The platform 188 mounts a motor 192 and other apparatus for reciprocating the hook 128 and driving the rollers 136 and 138. Such apparatus is probably best shown in FIG. 9.

Referring to FIG. 9 the motor 192 has a shaft 194 thereof mounting a pair of pulleys 196 and 198. The pulley 196 is coupled via a belt 200 to a pulley 202 mounted on the shaft 144 which mounts the roller 138. The shaft 144 is rotatably mounted at the lower surface 176 of the tabletop 32 by bearing blocks 204. At the same time that the motor 192 drives the roller 138, the pulley 198 mounted on the motor shaft 194 provides for reciprocation of the hook 128. The pulley 198 is coupled via a belt 206 to a pulley 208 mounted on a shaft 210. The shaft 210 which is rotatably mounted on the platform 188 by bearing blocks 212 mounts the second end 172 of the crank 170 thereon. Accordingly, as the shaft 210 is rotatably driven by the motor 192 via the pulleys 198 and 208 and the belt 206, the crank 170 is rotated so as to drive the hook 128 in reciprocating fashion via the connecting rod 162. As seen in FIG. 9 the bearing block 158 is mounted on the platform 188 by a support 214.

As previously noted, controls 62 are mounted on the frame 52. The controls 62 include a switch box 216 for turning the blower 186 on and off, for turning various stop motion devices such as the switch 109 on and off and for turning a pair of motor controls 218 and 220 on and off. The motor control 218 adjusts the motor 192 so as to vary the driving speed of the roller 138 and the speed of reciprocation of the hook 128. The motor control 220 adjusts the motor 12 so as to vary the rotational speed of the shaft 76.

It will be appreciated that fill yarn removal apparatus in accordance with the invention makes possible the removal of fill yarn virtually automatically. Manpower requirements are minimal. Normally, an operator is present only when the apparatus is being turned on or off or being adjusted. The speed of operation is significantly increased over that of manual fill yarn removal with speeds of 15 feet per minute of web advance being typical.

While the invention has been particularly shown and described with reference to a preferred embodiment thereof, it will be understood by those skilled in the art that various changes in form and details may be made therein without departing from the spirit and scope of the invention.

What is claimed is:

1. Apparatus for removing fill yarn from a web, the fill yarn extending across the width of the web between opposite edges of the web along the length of the web, comprising the combination of:

means for advancing the web through a work area;

means within the work area for cutting the fill yarn adjacent the opposite edges of the web as the web is advanced through the work area, the cutting of the fill yarn adjacent the different opposite edges of the web forming different lengths of the fill yarn extending across the width of the web; and means within the work area for removing the lengths of the fill yarn from the web, the means for removing including a hook and means for providing reciprocating movement of the hook into and out of the work area.

2. The invention set forth in claim 1, wherein the web includes a plurality of tows disposed side-by-side and extending along the length of the web, and further including means associated with the means for cutting for pulling an outer tow at each of the opposite edges of the web away from the other tows in the web so that the means for cutting cuts the fill yarn between each such outer tow and the other tows in the web, the means for pulling including a frame of given width disposed between the outer tow and the other tows and having the means for cutting disposed therein.

3. The invention set forth in claim 1, wherein the means for removing includes means for dividing the web along a central portion thereof to form a space between opposite portions of the web, the hook engaging the lengths of fill yarn in the space between opposite portions of the web and pulling the lengths of fill yarn out of the web.

4. Apparatus for removing fill yarn from a web, the web being comprised of a plurality of tows disposed in side-by-side relation across the width of the web and extending along the length of the web and a fill yarn being alternately interlaced across the width of the web between opposite edges of the web along the length of the web, comprising the combination of:

means for advancing the web lengthwise across a work surface in a downstream direction;

means located adjacent the work surface for pulling at least one tow at each of the opposite edges of the web away from the web;

means located at the work surface for cutting selected portions of the fill yarn extending between the at least one tow at each of the opposite edges of the web and the web to form different lengths of fill yarn extending across the width of the web;

means located at the work surface downstream of the means for cutting for dividing the web into two different groups of tows; and means located at the work surface downstream of the means for cutting and between the two different groups of tows of the web for removing from the two different groups of tows the different lengths of fill yarn.

5. The invention set forth in claim 4, further including means for maintaining a desired amount of tension in the at least one tow at each of the opposite edges of the web.

6. The invention set forth in claim 4, wherein the means for cutting includes a rotatable shaft disposed beneath the web and a pair of rotatable cutter wheels bearing on the shaft between the at least one tow at each of the opposite edges of the web and the web.

7. The invention set forth in claim 4, wherein the means for removing includes a hook disposed between the two different groups of tows and means for reciprocating the hook along a generally vertical path of movement.

8. The invention set forth in claim 7, further including a pair of opposite rollers mounted on opposite sides of the hook below the work surface, means for rotating the rollers in opposing directions, a hollow duct mounted below the pair of opposing rollers and having an aperture therein for receiving a portion of the hook, and means for providing an air stream through the inside of the duct.

9. Fill yarn removal apparatus comprising the combination of:

a relatively flat tabletop having opposite first and second edges and opposite upper and lower surfaces;

means for advancing a web across the tabletop from the first edge to the second edge;

a pair of cutting blades mounted in spaced-apart relation adjacent the first edge of the tabletop;

a hook mounted in the tabletop at a central portion thereof between the first and second edges, the hook being mounted for reciprocating movement between an upper position above the upper surface of the tabletop and a lower position below the lower surface of the tabletop; and means for reciprocating the hook.

10. The invention set forth in claim 9, further including a shaft extending upwardly from the upper surface of the tabletop and having a slot therein receiving the hook.

11. The invention set forth in claim 9, further including a pair of generally cylindrical rollers rotatably mounted on opposite sides of the hook below the lower surface of the tabletop and in contact with each other, each of the pair of rollers having a circumferential slot therein for receiving the hook, and means for rotatably driving the pair of rollers in opposing directions.

12. The invention set forth in claim 11, further including a hollow duct mounted below the pair of rollers and having a slot therethrough for receiving the hook, and a blower coupled to the duct for providing a stream of air therethrough.

13. The invention set forth in claim 9, further including two different pairs of spacer bars, each being mounted adjacent a different one of the pair of cutting blades and extending from an area above the upper surface of the tabletop to an area below the upper surface of the tabletop adjacent the first edge of the tabletop.

14. The invention set forth in claim 13, further including a pair of tow tensioning devices mounted in spaced-apart relation adjacent the second edge of the tabletop, each of the tow tensioning devices including an arm having a first end pivotally mounted adjacent the second edge of the tabletop and extending outwardly from the tabletop and terminating in a second end, and a wheel rotatably mounted on the second end of the arm.

15. The invention set forth in claim 14, further including means responsive to the orientation of the first end of each arm for terminating advance of the web across the tabletop from the first edge to the second edge when the arm pivots to a position indicating less than minimum acceptable tow tension.

16. The invention set forth in claim 9, further including a web dividing element mounted adjacent the second edge of the tabletop and extending upwardly to a level above the upper surface of the tabletop.

17. The invention set forth in claim 9, further including a generally cylindrical shaft rotatably mounted in a generally horizontal position adjacent the first edge of the tabletop and means for rotatably driving the shaft, wherein each of the pair of cutting blades comprises a cutting wheel rotatably mounted so as to bear on the shaft, and further including means for normally urging each cutting wheel into contact with the shaft.

18. The invention set forth in claim 17, further including means for directing a stream of air toward each of the pair of cutting blades.

19. The invention set forth in claim 9, wherein the hook has a relatively long shaft portion extending from a hook portion thereof, further including a mount disposed under the tabletop and mounting the shaft portion therein for movement along a generally vertical axis, and wherein the means for reciprocating the hook includes a connecting rod having a first end thereof pivotally coupled to a lower end of the shaft portion opposite the hook portion and an opposite second end, a crank having a first end thereof pivotally coupled to the second end of the connecting rod and an opposite second end which is pivotally mounted, and means for rotating the crank about the second end thereof.

* * * * *